US006010010A

United States Patent [19]

Heinle et al.

[11] Patent Number: 6,010,010

[45] Date of Patent: Jan. 4, 2000

[54] PROCESS FOR RECLAIMING A GRINDING SUSPENSION

[75] Inventors: Ewald Heinle, Durach; Alexander Grimm, Burggen; Holger Rubenbauer, München; Roman Kurth, Erftstadt, all of Germany

[73] Assignee: Elektroschmelzwerk Kempten GmbH, Munich, Germany

[21] Appl. No.: 09/164,903

[22] Filed: Oct. 1, 1998

[30] Foreign Application Priority Data

Oct. 2, 1997 [DE] Germany ..... 197 43 721

[51] Int. Cl.[7] ..... B03B 7/00; B03B 1/00

[52] U.S. Cl. ..... 209/12.1; 209/11; 209/3

[58] Field of Search ..... 209/3, 11, 12.1, 209/238, 248, 249, 223.2, 223.1; 210/406

[56] References Cited

U.S. PATENT DOCUMENTS

| | | | |
|---|---|---|---|
| 3,865,629 | 2/1975 | Dankoff et al. | 209/3 |
| 4,190,422 | 2/1980 | Hitzrot, Jr. | 209/3 |
| 5,470,466 | 11/1995 | Schaaf | 209/223.2 |
| 5,520,288 | 5/1996 | Drenter et al. | 209/12.1 |
| 5,647,989 | 7/1997 | Hayashi et al. . | |
| 5,830,369 | 11/1998 | Toyama | 210/773 |

FOREIGN PATENT DOCUMENTS

| | | | |
|---|---|---|---|
| 0502461 | 9/1992 | European Pat. Off. . | |
| 0742079 | 11/1996 | European Pat. Off. . | |
| 0767035 | 4/1997 | European Pat. Off. . | |
| 0786317 | 7/1997 | European Pat. Off. . | |
| 1555051 | 4/1990 | U.S.S.R. | 209/12.1 |

OTHER PUBLICATIONS

Derwent Abstract (#92–285668[35]) Corresponding to EP 0 502 461.

Derwent Abstract (#96–499183[50]) Corresponding to EP 0 742 079.

Patent Abstracts of Japan vol. 14, No. 119 (M–945 +JP 01 316170 A (Osaua Titanium).

Patent Abstracts of Japan (#M–945, Mar. 6, 1990, vol. 14/No. 119).

*Primary Examiner*—Donald P. Walsh
*Assistant Examiner*—Daniel K Schlak
*Attorney, Agent, or Firm*—Collard & Roe, P.C.

[57] ABSTRACT

A process for reclaiming a consumed grinding suspension which has been used for machining silicon, quartz or ceramic is made from a cutting fluid, in which abrasive grain and abraded material are dispersed. In a first process step, the grinding suspension is carefully separated, by means of a drying step, into a solid component and a liquid component. In a second process step, the solid component is separated into abrasive grain and abraded material by a separation method.

8 Claims, No Drawings

PROCESS FOR RECLAIMING A GRINDING SUSPENSION

BACKGROUND OF THE INVENTION

1. Field of the Invention

The present invention relates to a process for reclaiming a consumed grinding suspension which has been used for machining silicon, quartz or ceramic material. The suspension comprises a cutting fluid, in which abrasive particles and abraded material originating from the machined material are dispersed.

2. The Prior Art

To produce thin wafers made of silicon (electronics and solar applications) and quartz from monocrystalline rods or cast blocks, precise cutting ("precision wire sawing") has proven the most suitable process. In this process, a wire with a length of many kilometers is used. This wire is guided over a system of reels in such a way that a wire web having up to 450 mutually adjacent wires is formed. It is thus possible to produce up to 450 thin wafers simultaneously, in a single operation, from a block or rod of appropriate length. Abrasive particles, preferably green or dark SiC in different grain sizes, are used within the grinding suspension, in which these particles are suspended in a cutting fluid.

A batch of a suspension of this nature is buffered in a storage tank for use with one or more wire saws. From this tank, a defined volume of suspension is removed per unit time during the sawing process and is sprayed onto the wire web. A type of collecting tank is positioned beneath the wire web. The cutting suspension which contains abraded material produced during the process is collected in this collecting tank. From there, the suspension is continuously returned to the storage tank. As a result of the cutting suspension being returned to the storage tank, the process related abraded material in the storage tank builds up. This build up continues until the grinding suspension can no longer be used since its abrasive power is insufficient.

While the silicon or the quartz is being machined, the abrasive particles are contained in the grinding suspension, which is compressed and conveyed to the location where it is to carry out its material-removing action. This machining occurs with the aid of machine tools, for example band saws or wire saws or lapping wheels.

As the duration of use increases, the efficiency of the grinding suspension decreases. Thus the grinding suspension ultimately has to be replaced. This is because the desired machining result can no longer be achieved by means of the used grinding suspension.

In the past, there were various proposals for extending the service life, or the number of possible cutting operations of the grinding suspension. For example, it is possible to replace part of the used grinding suspension with fresh grinding suspension after each cutting operation. It is also possible to remove some of the abraded material by decanting.

A disadvantage of all these methods is that the used grinding suspension has to be disposed of after a large number of cutting operations. This disposal is normally carried out by storage as a special waste or by combustion of the carrier liquid with subsequent storage of the residual solid waste.

The cost of the abrasive particles is a major part of the overall costs of machining silicon, quartz or ceramic material. Thus the widespread practice of disposing of used grinding suspension as waste as soon as its efficiency has fallen below a minimum acceptable level is uneconomical.

It is known from Patent Abstracts of Japan, in JP 1-316170, to centrifuge used grinding suspension and to redisperse the abrasive particles recovered in fresh cutting fluid. A disadvantage is that a high proportion of abraded material and used cutting fluid remains in the recovered abrasive grains. Moreover, the separated used cutting fluid has to be disposed of as usual.

SUMMARY OF THE INVENTION

It is an object of the present invention to provide a process which is as simple as possible, and which makes it possible to use the abrasive particles for a longer time period for machining silicon or quartz, and which avoids the drawbacks of the prior art.

The above object is achieved by means of a process according to the present invention. This process is for reclaiming a consumed grinding suspension which has been used for machining silicon, quartz or ceramic material, in which the suspension comprises a cutting fluid, in which abrasive particles and abraded material are dispersed. In a first process step, the grinding suspension is carefully separated, by means of a drying step, into a solid component and a liquid component and, in a second process step, the solid component is separated into the abrasive particles and abraded material by classifying methods which are known per se.

It is possible to reuse all the components of the used grinding suspension which are obtained separately by means of the process according to the invention. Thus, there is no longer any special waste which has to be disposed of later.

Suitable drying method steps in the process according to the invention are, for example, belt drying methods, spray drying methods or vacuum drying methods. Vacuum drying methods, and in particular vacuum thin-film evaporation, are preferred.

Dry separating methods, such as screening methods or sifting methods, are preferably used as the separation method. A sifting method, e.g. gas classification by means of pneumatic sifter or air cyclone, is preferably used.

The service life during which the grinding suspension can still profitably be used for the machining of silicon, quartz or ceramic material depends on the extent to which abraded material is incorporated into the grinding suspension. The abraded material originates predominantly from the silicon, quartz or ceramic material, but also from the abrasive particles and from the wire. Depending on the cutting fluid used, moisture is also absorbed from the air. As the duration of use increases, ever more particles of abraded material attach themselves to the abrasive particles and form agglomerates with the abrasive particles. These agglomerates, in contrast to the free abrasive particles, are no longer suitable as the material-abrading component of the grinding suspension. Thus, it is desirable to exchange used grinding suspension as soon as a certain volume of abraded material has been incorporated into the grinding suspension.

The process according to the invention makes it possible to recover abrasive particles from a grinding suspension which can no longer be used for machining silicon, quartz or ceramic material.

To reclaim the used grinding suspension which, in contrast to unused grinding suspension, contains a certain amount of abraded material, this suspension is firstly heated. This heating is preferably by means of vacuum thin-film evaporation, to temperatures which are above the boiling point temperature of the cutting fluid or liquid used at the selected pressure. Preferably a subatmospheric pressure is used and the evaporated cutting liquid fluid is then condensed.

The abrasive is preferably heated to temperatures of 120–150° C. at about 10 mbar absolute pressure. The object of this first process step is to separate the solid and liquid fractions of the grinding suspension. If the process is carried out carefully, the liquid fraction can immediately be reused for preparing a fresh grinding suspension.

The solid fraction is separated into different particle sizes by means of a separation method. It is possible for the particle size to correspond to the grain size of the abrasive particles which were originally used. Thus they may be reused immediately. In another embodiment, it is possible to admit a small amount of fresh SiC into the grinding suspension for machining the silicon, quartz or ceramic material (e.g. a wire sawing process).

For this purpose, the SiC fraction obtained by means of the separation and classification method is redispersed, with vigorous agitation, into fresh cutting fluid. The SiC fraction can be redispersed into the cutting fluid originating from the drying step.

The fine fraction which was separated out during separation and classification comprises the abraded material. This fine fraction may be used for metallurgical purposes. Thus there is generally no special waste whatsoever produced by the process according to the invention. The process according to the invention can be applied to all known grinding suspensions for machining silicon, quartz or ceramic material in which the abrasive particles are dispersed in a cutting fluid.

Preferred as cutting fluids are liquids which can be distilled without decomposition under the abovementioned conditions. Examples of these cutting fluid liquids include polyhydroxy alcohols, such as ethylene glycol, propylene glycol, and mixtures thereof.

The preferred abrasives are particles of hard material, for example of aluminum oxide, silicon carbide or boron carbide. The average grain diameters of these abrasive particles preferably range from 5 to 30 $\mu$m.

The invention process for recovering abrasive particles preferably is carried out if the weight ratio of cutting fluid to abrasive particle in the unused abrasive ranges from 2:1 to 1:2. Preferably, the weight ratio of cutting fluid to abrasive particle ranges from 1:1 to 1:1.5.

The recovery of abrasive particles from a used grinding suspension has been described by reference to grinding suspensions for machining silicon or quartz. This process can also be applied to grinding suspensions which are used for the machining of other hard brittle material, for example glass or ceramic.

The present invention will now be further described by reference to the following example which is not to be deemed limitative of the present invention in any manner thereof.

DETAILED DESCRIPTION OF PREFERRED EMBODIMENTS

EXAMPLE

First, a grinding suspension was prepared by dispersing 20 kg of silicon carbide particles having an average diameter of 14 $\mu$m in 20 kg of a polyhydroxy alcohol such as ethylene glycol used as the cutting fluid.

Then, using this grinding suspension, it was possible to cut approximately 400 wafers having a diameter of 200 mm from a monocrystalline silicon crystal by precision wire sawing. By this time, 1 kg of abraded silicon (based on 10 kg of abrasion-free grinding suspension) had been incorporated into the used grinding suspension.

The used grinding suspension was then separated into a solid phase and a liquid phase using a vacuum thin-film evaporator with a heating surface of 0.5 $m^2$ at a rotor speed of 800 rpm, a temperature of 225° C. and a pressure of about 25 mbar.

The pulverulent solid was dried so as to be 99.5% dry. The solid was separated using a pneumatic sifter at a rotor speed of 4500 rpm, and the yield of regenerated target product was 65%.

The silicon carbide abrasive particles recovered in this way were dispersed in about 15 kg of fresh cutting fluid with stirring and was then used for the precision wire sawing of further silicon wafers.

Using the same setting parameters as for the use of unused silicon carbide, approximately 320 silicon wafers were produced with identical results in terms of productivity and quality.

Accordingly, while a few embodiments of the present invention have been shown and described, it is to be understood that many changes and modifications may be made thereunto without departing from the spirit and scope of the invention as defined in the appended claims.

What is claimed is:

1. A process for reclaiming a consumed grinding suspension which has been used for machining a solid selected from the group consisting of silicon, quartz and ceramic material, comprising providing a grinding suspension comprising a cutting fluid, in which abrasive particles and abraded material are dispersed;

separating the grinding suspension by means of drying into a solid component and a liquid component; and, separating the solid component into said abrasive particles and said abraded material; and wherein said drying is vacuum drying.

2. The process as claimed in claim 1, wherein said separating is selected from the group consisting of screening and sifting.

3. The process as claimed in claim 1, wherein the abrasive particles are heated to a temperature of from 120–150° C. at about 10 mbar absolute pressure during the vacuum drying step.

4. The process as claimed in claim 1, wherein the weight ratio of cutting fluid to abrasive particles in the unused abrasive ranges from 2:1 to 1:2.

5. In a method for machining silicon, quartz or ceramic, the improvement which comprises, utilizing the liquid component obtained in accordance with the process as claimed in claim 1 as a cutting fluid for the machining of silicon, quartz or ceramic.

6. In a method for machining silicon, quartz or ceramic, the improvement which comprises, utilizing the abrasive particles obtained in accordance with a process as claimed in claim 1 for the machining of silicon, quartz or ceramic.

7. The process as claimed in claim 1, wherein the cutting fluid is a polyhydroxy alcohol.

8. The process as claimed in claim 1, wherein the cutting fluid is selected from the group consisting of ethylene glycol, propylene glycol, and mixtures thereof.

* * * * *